US006394793B1

(12) United States Patent
Bunge

(10) Patent No.: US 6,394,793 B1
(45) Date of Patent: May 28, 2002

(54) METHOD AND APPARATUS OF COOLING HEAT-TREATED WORK PIECES

(75) Inventor: Gene Bunge, Greendale, WI (US)

(73) Assignee: Ladish Company, Incorporated, Cudahy, WI (US)

( * ) Notice: Subject to any disclaimer, the term of this patent is extended or adjusted under 35 U.S.C. 154(b) by 0 days.

(21) Appl. No.: 09/760,320

(22) Filed: Jan. 13, 2001

(51) Int. Cl.[7] ..... F27D 15/02

(52) U.S. Cl. ..... 432/85; 432/14; 266/258; 266/259; 148/714

(58) Field of Search ..... 432/14, 77, 85; 266/251, 258, 259; 148/559, 714

(56) References Cited

U.S. PATENT DOCUMENTS

| | | | | |
|---|---|---|---|---|
| 2,280,064 A | * | 4/1942 | Denneen et al. | 266/259 |
| 2,305,811 A | | 12/1942 | Oeckl | |
| 2,890,975 A | | 6/1959 | Lenz | |
| 3,470,624 A | | 10/1969 | Plotkowiak | |
| 4,278,421 A | | 7/1981 | Limque et al. | |
| 4,610,435 A | | 9/1986 | Pfau et al. | |
| 4,653,732 A | | 3/1987 | Wunning et al. | |
| 4,767,473 A | | 8/1988 | Berg | |
| 4,769,092 A | | 9/1988 | Peichl et al. | |
| 4,810,311 A | | 3/1989 | Economopoulos | |
| H777 H | | 5/1990 | Natarajan | |
| 4,938,460 A | | 7/1990 | Wechselberger et al. | |
| 4,953,832 A | * | 9/1990 | Kotsch et al. | 266/259 |
| 5,419,792 A | | 5/1995 | King et al. | |
| 5,759,309 A | * | 6/1998 | Watts et al. | 148/714 |
| 5,770,146 A | | 6/1998 | Ebner | |
| 6,074,599 A | | 6/2000 | Murty et al. | |

* cited by examiner

*Primary Examiner*—Jiping Lu
(74) *Attorney, Agent, or Firm*—Boyle Fredrickson Newholm Stein & Gratz, S.C.

(57) ABSTRACT

A method and apparatus for cooling heat-treated metallic work pieces, particularly jet engine components that are normally round in shape, have a complex radial cross-section, and are subject to subsequent machining steps, includes a set of concentric air quench delivery tubes for directing a compressed air quench onto specified areas of the work piece for cooling. A first set of tubes is located above the work piece, and a second set of tubes is located below the work piece. The tubes include a multiplicity of bores around their circumference. The air quench tubes are placed in close proximity to the relatively thicker and more massive portion of the work piece, while the thinner and less massive portions are allowed to cool in normal ambient air, thereby cooling the entire part at a substantially uniform rate. Shields placed at specified locations blocks the flow of compressed air and redirect it away from the thin portions of the part.

26 Claims, 7 Drawing Sheets

METHOD AND APPARATUS OF COOLING HEAT-TREATED WORK PIECES

BACKGROUND OF THE INVENTION

1. Field of the Invention

The present invention relates a method and apparatus for cooling and quenching metallic work pieces. In particular, the invention relates to a method and apparatus for cooling heat-treated parts through an air quenching system especially adapted for use in cooling parts having complex shapes, such as various components used in jet and gas turbine engines. The method and apparatus disclosed below are designed primarily for the purpose of uniformly cooling complex-shaped parts that under convention quenching techniques exhibit varying cooling rates. The method and apparatus disclosed below may be adapted to produce controlled differential cooling rates at different portions of the part.

2. Background of the Related Art

Metal parts are commonly heat-treated to improve the wear and strength characteristics of the part. The heat-treating of steel and other metals is a well known, but highly complex process that is designed to alter the microstructure of the material. Strength and wear characteristics of a particular type of steel are normally dependant upon the percentage of carbon and other alloy materials that make up the steel, and also upon the rate that the part is cooled after it has been heated. It is common to cool heated parts by immersing the part in a fluid bath. This process of cooling the part is referred to in the trade as "quenching".

Heat-treating refers to the heating of a steel part, usually in a furnace, to a temperature above a critical temperature whereupon the steel undergoes a phase transformation. Quenching refers to the process of rapidly cooling the heated part at a cooling rate that is sufficient to maintain certain molecular compositions of the metal acquired during heating, or to obtain certain desired molecular characteristics that form during the quenching process. As a general proposition, quenching of steel work pieces has been conventionally accomplished by immersing the part in a liquid coolant, typically water or oil.

In the heat treatment of metals, a wide variety of cooling arrangements have been utilized in an effort to achieve a uniform cooling of the work piece. For most applications, uniform cooling of the entire work piece is desired because that will promote the development of a uniform grain structure within the metal composition and minimize distortion of the piece. Various cooling methods have been employed in an effort to develop a desired microstructure of the material and desired mechanical properties while avoiding physical defects in the part, such as cracking or distortion of the part. It is also desirable to also to control residual stresses within the part, which can affect the machinability of the part during subsequent manufacturing steps and also affect the operating life and characteristics of the part.

Certain parts are subjected to extremely high stresses during use. For example, various components in jet aircraft engines and gas turbine generators, particularly the rotational components, are subjected to very high centrifugal forces and thermal stress during use. Such parts also typically have very complex shapes, with a portion of the part being relatively thick and thus having a relatively large mass, while other portions of the part are quite thin and have a relatively low mass. When heated, the thick, massive portions of the part naturally retain a large amount of heat energy. Because heat dissipates quite quickly from the thin portions of the part but is retained for a longer period of time in the more massive portions of the part, it is extremely difficult to cool such complex-shaped parts uniformly.

Quenching has commonly been performed with water, oil and other liquid coolants. For parts having complex shapes, though, the use of a liquid coolant does not ordinarily provide uniform cooling throughout the part. A liquid coolant will cool the surface of the part very rapidly. However, the inner portion of the thicker and more massive portion of the part cools at a much slower rate. The difference in the cooling rates between the surface of the part and the inner portions of the part result in the creation of internal stresses in the part. Such internal stresses can cause substantial distortion of the part, particularly during later machining and use. Jet and gas turbine engine parts must ordinarily be manufactured to very tight tolerances, and so the amount of permissible distortion during machining is very small.

While an oil bath is the most common quenching medium used for heat-treating purposes, air and other cooling gases have also been used in certain limited circumstances to cool heated parts. Air quenching has the advantage of producing a slower cooling of the part than can be achieved with an oil bath. A variety of methods and apparatus for cooling work pieces with air are known. However, these known methods have in most instances only a limited capability to cool of work pieces of relatively simply geometries. For example, U.S. Pat. No. 2,305,811 to Oeckl relates to the heat treatment of light metal work pieces. The work piece is contained within a chamber, and cooling fluid is supplied through nozzles in the walls. The work piece is subjected to a cloud of atomized cooling fluid, which is then exhausted from the chamber. As another example, U.S. Pat. No. 4,278,421 to Limque et al. discloses an industrial furnace that includes a means for supplying a quenching gas. The quenching gas is circulated by a heavy-duty blower that directs air to a funnel-shaped hood for delivering the air to the work piece for cooling. U.S. Pat. No. 4,769,092 to Peichl et al. discloses the use of nozzles for spray arms for directing a cooling medium onto a work piece.

Statutory Invention Registration No. H777 to Natarajan discloses a method for quenching metal work pieces by directing streams of gas coolant at high velocity and flow rates against the work piece. U.S. Pat. No. 5,770,146 to Ebner relates to a stream for the heat treatment of metallic parts that includes a number of tubular nozzles for directing a cooling medium against the part. The nozzles include telescopically retractable extensions for adjusting the distance between the nozzle and the part. U.S. Pat. No. 6,074,599 to Murty et al. relates to an air quenching system that includes a plurality of air discharge orifices, and a corresponding plurality of air exhaust orifices for circulating air through a cooling chamber. Parts are transported through the cooling chamber on an air previous conveyor belt so that the parts can be cooled from cooling air supplied from both above and below the conveyor.

Additional quenching and cooling systems are disclosed in U.S. Pat. No. 3,470,624 to Plotkowiak, U.S. Pat. No. 610,435 to Pfau et al., U.S. Pat. No. 4,653,732 to Wunning, U.S. Pat. No. 4,767,473 to Berg, U.S. Pat. No. 4,810,311 to Economopoulos, U.S. Pat. No. 4,938,460 to Wechselberger et al., U.S. Pat. No. 2,890,975 to Lenz, U.S. Pat. No. 5,419,792 to King et al.

However, the uniform cooling of work pieces having a complex size and shape requires a different cooling method and apparatus than heretofore has been disclosed or reported. As mentioned, such parts, particularly rotational parts for jet engines, have varying thickness and commonly have protrusions that impede or block the flow of cooling fluid. Consequently, an improved method and apparatus for cooling and quenching particularly rotational parts having complex shapes and cross sections is desired.

SUMMARY OF THE INVENTION

A method and apparatus for cooling and quenching heat-treated metallic work pieces is disclosed. The invention is especially adapted for use in quenching work pieces that are later machined and used as components in jet and gas turbine engines. The work piece is typically round or circular in shape. Consequently, it has a radial cross-section that is uniform about its entire circumference. Additionally, the radial cross-section of the part, when viewed from the axis to the outer circumference of the part, has a complex geometry that includes at least one portion that is relatively thick and has a large mass, and at least one portion that is relatively thin and has a low mass.

The apparatus includes an appropriate fixture for supporting the work piece, preferably in a horizontal orientation. Specified portions of the work piece are surrounded by a set of tubes used for directing a compressed air quench onto the work piece for cooling. At least one, and preferably several tubes are located above the work piece, and at least one and preferably several tubes are located below the work piece. The tubes are likewise circular in shape, and preferably oriented horizontally on the fixture. The work piece is placed onto the fixture so that it shares a common axis with the air quench tubes. The air quench tubes are placed in close proximity to the relatively thicker and more massive portion of the work piece.

Each tube is connected to a source of compressed air for supplying the air quench to the work piece. Additionally, each tube is provided with a multiplicity of bores around the circumference of the tube. The bores, which are essentially holes drilled into the tube, are aimed at the work piece so that the compressed air flows onto the thick, massive portion of the work piece, and away from the thin, less massive portion of the work piece.

The fixture is designed to include a number of air quenched delivery tubes in a fixed location underneath the work piece. Additionally, the fixture includes several tubes that are mounted on a slide for moving the tubes toward and away from the work piece as needed.

The apparatus also optionally includes shielding that essentially blocks the flow of compressed air and redirects it away from the thin portions of the part.

The method of the invention includes the steps of heat treating a work piece as described above to a pre-determined temperature and for a pre-determined time; removing the work piece from the furnace and placing it into a fixture for cooling; placing a set of circular tubes in close proximity to the thicker, more massive portions of the work piece; providing a source of compressed air to the tubes; and, directing the compressed air onto the part so that most of the cooling air is directed onto the thicker, more massive portions of the part and that less cooling is directed onto the thinner, less massive portions of the part.

With this apparatus and method, the cooling rate of the thicker, more massive portions of the part is maximized, while the cooling rate of the thinner, less massive portions of the part is simultaneously minimized. The invention disclosed herein thereby provides an overall cooling of the entire work piece at a much more uniform rate than is possible with conventional quenching methods. By cooling both the thicker more massive portions of the part at nearly the same rate as the thinner less massive portions of the part, the wide variation of internal stresses that are normally produced during conventional quenching is avoided. As a result, the part may be machined more uniformly, with little to no deformation as compared to parts that have been quenched using conventional methods.

The method and apparatus may be further adapted to produce controlled differential cooling rates upon different portions of the part. In other words, it is possible to manipulate the method and apparatus disclosed herein to invert the natural cooling rates of the part so that the more massive portions of the part actually cool more quickly than the thin portions of the part, and thereby selectively produce a certain desired internal stress in the part in order to achieve a certain desired characteristic.

Other objects and advantages of the present invention will become apparent from the following description, which sets forth by way of illustration and example certain preferred embodiments of the present invention.

BRIEF DESCRIPTION OF THE DRAWINGS

The drawings, which constitute a part of the specification and illustrate exemplary embodiments of the present invention, include the following.

DETAILED DESCRIPTION OF THE INVENTION

Figure 1:
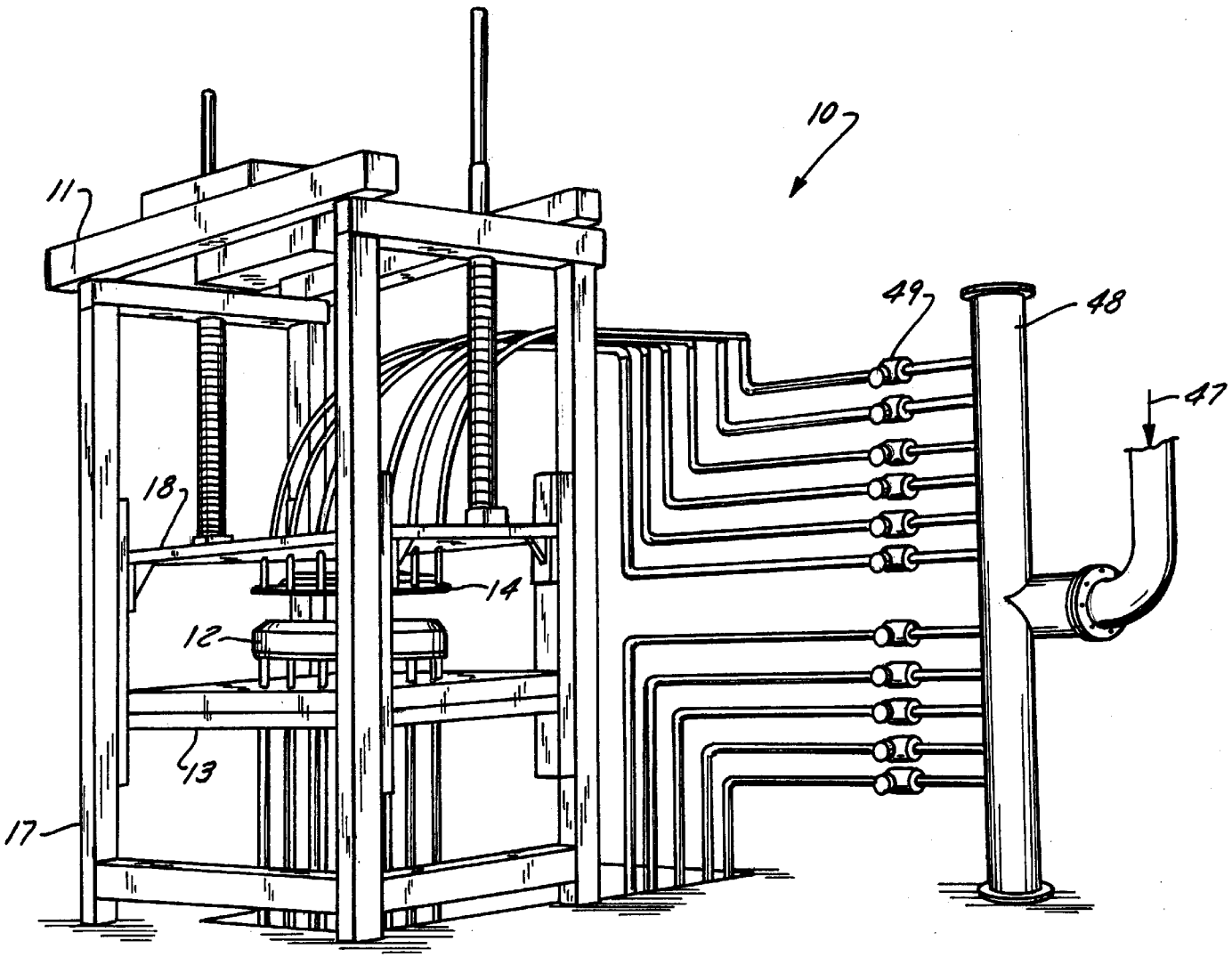
FIG. 1 is a perspective view of an apparatus for cooling work pieces in accordance with the principles of the present invention.

The present invention is designed especially for use in the manufacture of discs, spools, and other components used particularly in large and small jet engines and gas turbine generators. During the manufacture of such components, an appropriately shaped work piece is produced by casting or forging. Such work pieces are often made of a high temperature alloy or super alloy of the type commonly used in the jet engine field. In order to produce the formation of the desired microstructure and mechanical properties for the component, the work piece is heat-treated by heating it in an industrial furnace for a predetermined time and up to a predetermined temperature, and then cooled. Typically, the part is heated to a uniform temperature in the order of between 1475° F. and 2250° F., and held at that temperature for a sufficient length of time for the part to develop a desired microstructure. The cooling step, often referred to in the trade as quenching, is critical to obtaining the desired strength, life and machining characteristics of the component.

The present invention includes a method and apparatus that provide controlled cooling after heating of complex-shaped components. The types of discs, spools and other jet and gas turbine engine components for which the present invention is especially designed rotate during use at very high speeds. Thus, the work piece being heat-treated is ordinarily substantially circular in shape. Parts that are circular, cylindrical or round have a radial cross-section that is uniform about the entire circumference of the part. That is, when looking at the cross-section of a cylindrical part measured from its axis to its outer circumference, the geometry of the cross-section is the same at all point around the entire circumference of the part. For example, the radial cross-section of a plain flat disc is a simple rectangle. The shape of such rotating parts is referred to in the trade as a shape of revolution. However, components for jet and gas turbine engines commonly comprise a radial cross-section that has a complex geometric shape. That is, when measured in the axial direction, a jet engine part commonly includes at least one portion that is relatively thick and massive compared to a second portion that is in comparison quite thin and less massive. Additionally, the part may comprise a thin ridge or fin that protrudes outwardly from the main body of the part, or it may have a channel or groove cut inwardly into the part. Some jet engine parts may have both ridges and grooves. Such different portions of the part exhibit different natural cooling characters. That is, the relatively thicker and more massive portions of the part naturally retain the heat for a longer period and thus take longer to cool, while the thinner and less massive portions of the part are capable for dissipating heat very quickly and thus can be cooled very quickly. The present invention is directed to controlling the cooling rates of certain specified portions of the part. More specifically, the invention is directed to the cooling of complex-shaped parts at a substantially uniform rate, or alternatively, to impose a selected cooling rate upon certain specified portions of the part for the purpose of producing a desired internal stress and thereby acquire a certain desired characteristic of the part.

Referring to FIG. 1, an apparatus 10 for cooling work pieces of the present invention includes a fixture 11 for holding the work piece 12 in place, and means for directing compressed air to the desired portions of the work piece. One or more furnaces (not shown) for heating the work piece are located nearby the cooling apparatus. Upon heating in the furnace, the work piece 12 is removed and immediately placed onto the fixture for cooling.

The fixture 11 includes an upper portion and a lower portion. The lower portion of the fixture includes a support stand 13 for supporting the work piece 12 in a substantially horizontal orientation. The fixture 11 further includes a means for centering the work piece 12 so that the circular work piece and circular air quench delivery tubes (discussed further below) share a common axis. The means for centering the work piece on the fixture may include any one of a number of conventional methods, which typically involves some type of physical feature of the work piece fitting into a specific portion of the fixture. For example, referring to FIG. 3, the part being cooled has a downward protruding ridge that fits into a cup shaped metallic shield (the importance of shielding is also discussed further below), which ensures that the part is properly centered on the fixture. Alternatively, some type of pin that fits into a corresponding aperture in the work piece may be employed, as well as other equivalent methods commonly used and well known in the industry.

Figure 2:
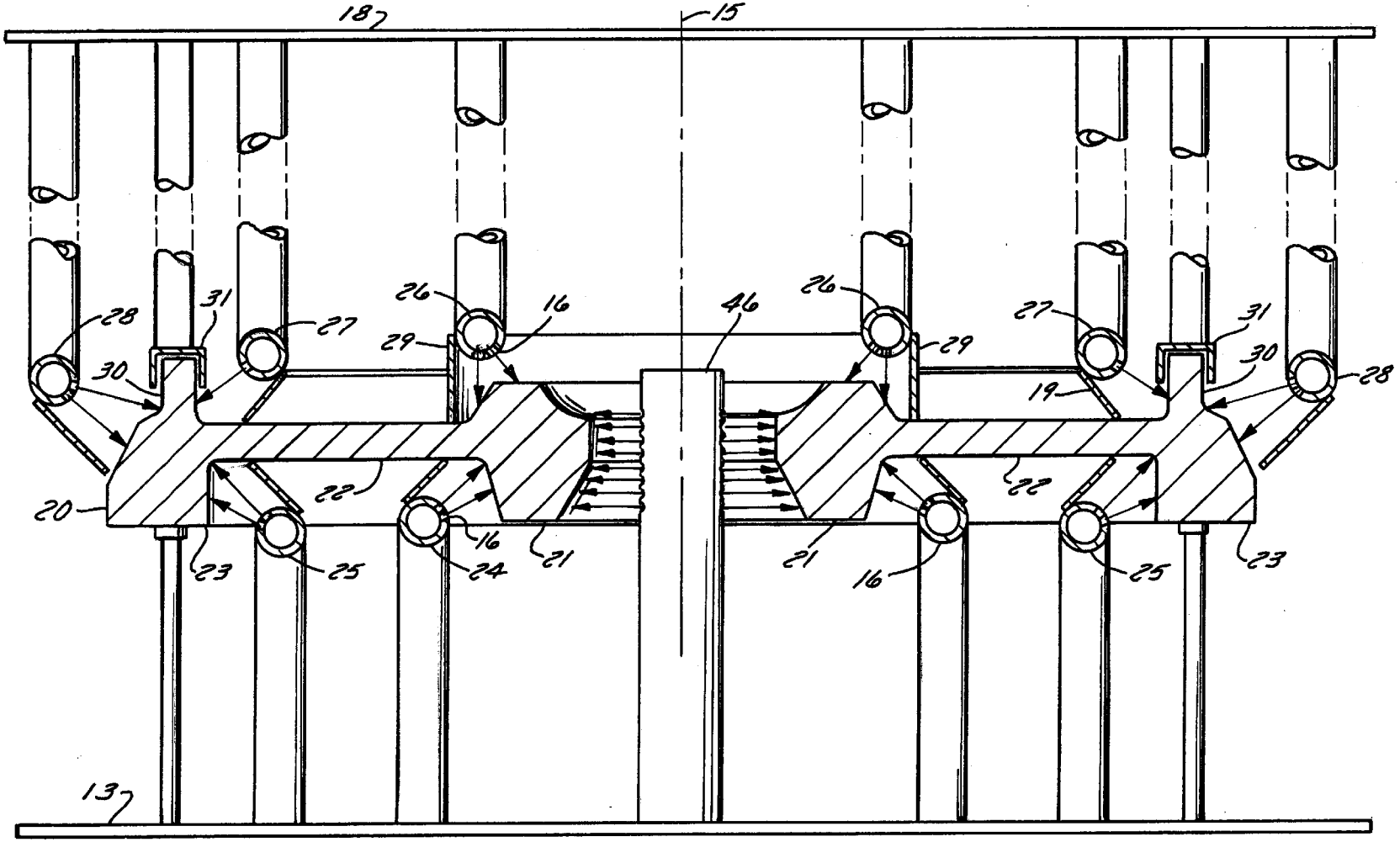
FIG. 2 is a cross-sectional view of a first embodiment of the apparatus for cooling work pieces of the present invention.
Figure 3:
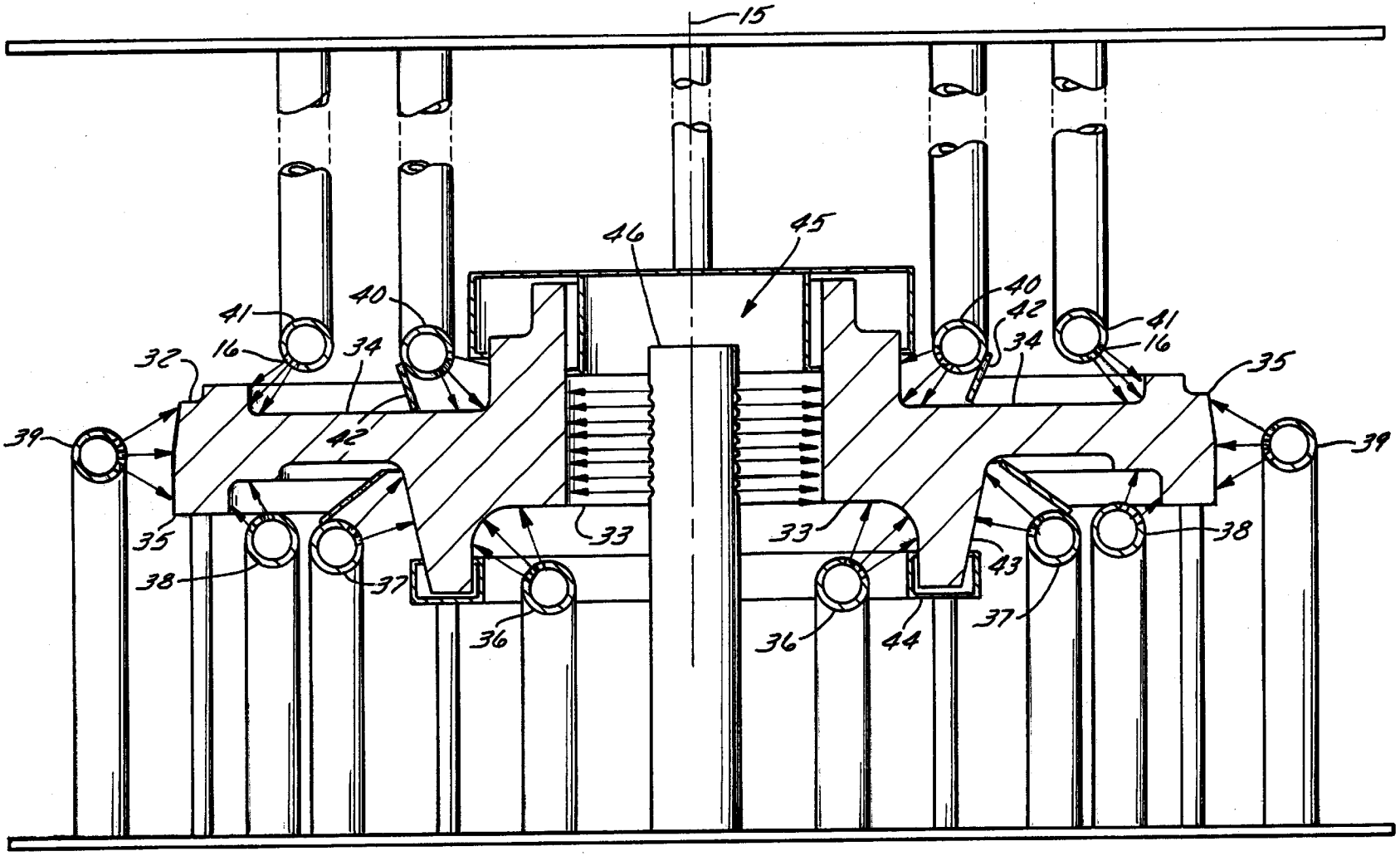
FIG. 3 is a cross-sectional view of a second embodiment of the apparatus for cooling work pieces of the present invention.

The fixture 11 includes a set of tubes 14 located in close proximity to the work piece. The tubes are used to deliver and direct a compressed air quench onto the work piece for cooling. The number and exact placement of the tubes depends upon the specific geometry of the work piece and the desired characteristics cooling effects. However, in all instances the tubes are circular in shape to correspond to the circular shape of the part. Thus, by centering the work piece onto the fixture in the manner discussed above, the circular work piece and circular tubes share a common axis 15, and are thus concentrically oriented relative to each other. The cross-section of the tubes 14 illustrated in FIGS. 2 and 3 are, incidentally, also circular, but tubes having a circular cross-section is not critical to the invention. Tubes with circular cross-sections are most commonly available, but tubes with square or other cross-sections are also available and may be utilized in certain circumstances.

Additionally, each air quench delivery tube is located in close proximity to a thicker and more massive portion of the part. The tubes are preferably positioned within the range of about ¼ to about 6 inches from the part. Each tube is also connected to a source 47 of compressed air for quenching the work piece. Moreover, each tube includes a multiplicity of bores or nozzles 16 aimed at the work piece. The bores are located sufficiently close to each other, and preferably between approximately 1/16 (one sixteenth) and 2 inches apart from each other, so as to create a curtain of cooling air onto the desired portions of the part. When the quenching process is initiated, compressed air flows through the tubes and through the bores, and the air is further directed onto the portions of the work piece that are substantially thicker and more massive and away from the portions that are relatively thinner and less massive.

As mentioned, the work piece is preferably supported on the fixture in a horizontal position, and at least one air quench delivery tube is positioned above the work piece, and at least one other air quench delivery tube is positioned below the work piece. The air quenched delivery tubes located below the work piece are fixed to the lower portion of the fixture 17. The air quenched delivery tubes that lie above the work piece are connected to a movable slide 18 that moves vertically toward and away from the work piece, as illustrated in FIG. 1, and also in FIGS. 2 and 3.

The fixture also includes shielding also for directing the compressed air onto the thick, massive portions of the part, and also for blocking the flow of compressed air away from the thinner and less massive portions of the part. In that regard, a shield, such as shield 19 in FIG. 2, extends from a side edged portion of the tube downward toward the surface of the work piece. The portion of the shield adjacent the work piece is positioned generally at the junction dividing the relatively thicker more massive portions of the part from the thinner less massive portions of the part. Thus, air flowing from the tube is directed against the thick portion of the part, and is prevented from flowing onto the thin portion of the part. Additional shielding may be placed over ridges that protrude away from the main body of the part, again for the purpose of blocking the flow of compressed air to that portion of the part.

FIGS. 2 and 3 illustrate the two exemplary part geometries of the type that are heat treated and cooled in accordance with the principals of the invention. Referring to the part illustrated in FIG. 2, part 20 has a radial cross-section that includes a first portion 21 that is relatively thick and massive, a second portion 22 that is quite thin and less massive, and a third portion 23 that is also quite thick and massive. The part 20 is mounted horizontally on to the fixture. Beneath the part are two air quench delivery tubes, the first tube 24 being placed in close proximity to the first portion 21 of the part, and the second tube 25 being placed in closed proximity to the third portion 23 of the part 23. Above the part, a plurality of air delivery tubes is also placed in close proximity to the thicker and more massive portions of the part. Specifically, in reference to FIG. 2, a third tube 26 is placed in close proximity to, but above, the first portion of the part. Similarly, a fourth tube 27 and fifth tube 28 are placed in closed proximity to the third portion 23 of the part. Compressed air flows from the tubes onto the surface of the part. As mentioned, the air quench delivery tubes, as well as the part, are round. Thus, looking at FIG. 2, tubes 24–28 on the left side of the figure are pneumatically connected to tubes 24–28 that appear on the right hand side of the drawing.

FIG. 2 also illustrates the shielding for directing and blocking the flow of air away from the second thinner and less massive portion 22 of the part. For example, shield 29 extends downwardly from a side edge of the third tube 26 downward toward the surface of the part. The bottom edge of the shield 29 is placed at the junction of the part that effectively delineates the first thick portion 21 of the part from the second thin portion 22. Consequently, air flows from the third tube 26 onto the upper surface of the part, thus cooling the thicker first portion of the part. The shield 29 further blocks the air from flowing onto or across the thin second portion of the part 22. As a result, the cooling rate of the thick portions of the part, which contains the most metal material and thus retains the most heat, is maximized, while the cooling rate of the thinnest portion of the part is minimized.

FIG. 2 also illustrates the type of ridge 30 that protrudes outwardly from the main body of the part that is commonly found in jet engine parts. Shield 31 is used for a similar purpose. That is, shield 31 essentially covers over the ridge 30, thereby blocking the flow of compressed from passing air over and across the ridge, which again minimizes the cooling rate of the material forming the ridge.

FIG. 3 shows a further example of a metallic work piece of the type found on jet engines components. The work piece 32 in FIG. 3 also has a radial cross-section that has a complex geometry that includes a first portion 33 that is relatively thick and massive, a second portion 34 that is quite thin and less massive, and a third portion 35 that is also quite thick and massive. Beneath the part are four air quench delivery tubes 36, 37, 38 and 39. The first tube 36 and second tube 37 are placed in close proximity to the first portion 33 of the part, and the third tube 38 and fourth tube 39 are placed in closed proximity to the third portion 35 of the part. Above the part, a fifth air delivery tube 40 is placed in close proximity to the first portion 33, and a sixth air quench delivery tube 41 is placed in close proximity to the third portion of the part 35. The four tubes 36, 37, 38 and 39 underneath the part are fixed in a stationary position on the lower portion of the fixture, and the two tubes 40 and 41 located above the part are mounted on a slide and are thus vertically moveable toward and away from the part as needed. The part and air quench delivery tubes are round, and the part is mounted horizontally on to the fixture so that the part and tubes share the same central axis and are thus concentrically oriented relative to each other.

FIG. 3 also illustrates a shield for directing and blocking the flow of air away from the second thinner and less massive portion of the part. Specifically, shield 42 extends downwardly from a side edge of the fifth tube 40 downward toward the surface of the part. The bottom edge of the shield 42 is placed at the junction of the part that effectively delineates the first thick portion of the part 33 from the second thin portion 34. The shield 42 blocks the air from flowing onto or across the thin portion of the part. The part illustrated in FIG. 3 further include a ridge 43 that protrudes outwardly from the main body, and shield 44 essentially covers over the ridge, thereby blocking the flow of compressed from passing air over and across the ridge, which again minimizes the cooling rate of the material forming the ridge.

The part illustrated in FIG. 3 also has an open bore 45 in the middle of the part. The bore 45 is adjacent to the first portion of the part 33, which is relatively thick and massive. In order to provide additional cooling to that portion of the part an axial air quench delivery tube 46 extending upward into the central bore is provided. The axial air quench delivery tube 46 also contains a number of bores or nozzles for directing compressed air into that portion of the part for additional cooling.

Additional air quench tubes can be added or repositioned as may be required depending on the particular geometry of the part being cooled. The system disclosed above is designed particularly for use with a plant air supply pressure on the order of approximately 100 psig., but the system could be adapted for use with any other appropriate cooling gas at a pressure great enough to obtain the desired cooling rates. Other types of cooling gases that may be employed include argon, carbon dioxide ($CO_2$) or nitrogen.

The preferred embodiments described above in connection with FIGS. 2 and 3 deliver compressed air from a common source 47 and thus at a common pressure and temperature. However, the apparatus and method disclosed herein may be further adapted to supply cooling air at different pressure values to the various air quench tubes through the use of an air manifold 48. In other words, using FIG. 3 as an example, the first tube 36 could be supplied with compressed air at a first pressure value, the second tube 37 supplied with compressed air at a second pressure value, the third tube 38 supplied with compressed air at a second pressure value, and so forth. Moreover, the pressure values for each tube may be adjusted over time during the cooling step. In other words, and again using FIG. 3 as an example, the first pressure value of the cooling air supplied to the first tube 36 could be increased (or decreased) over time, the second pressure value of the cooling air supplied to the second tube 37 could be increased (or decreased) over time, the third pressure value of the cooling air supplied to the third tube 38 could be increased (or decreased) over time, and so forth. One or more of the tubes could also be retracted away from the work piece at a particular point during the quenching process.

Figure 4:
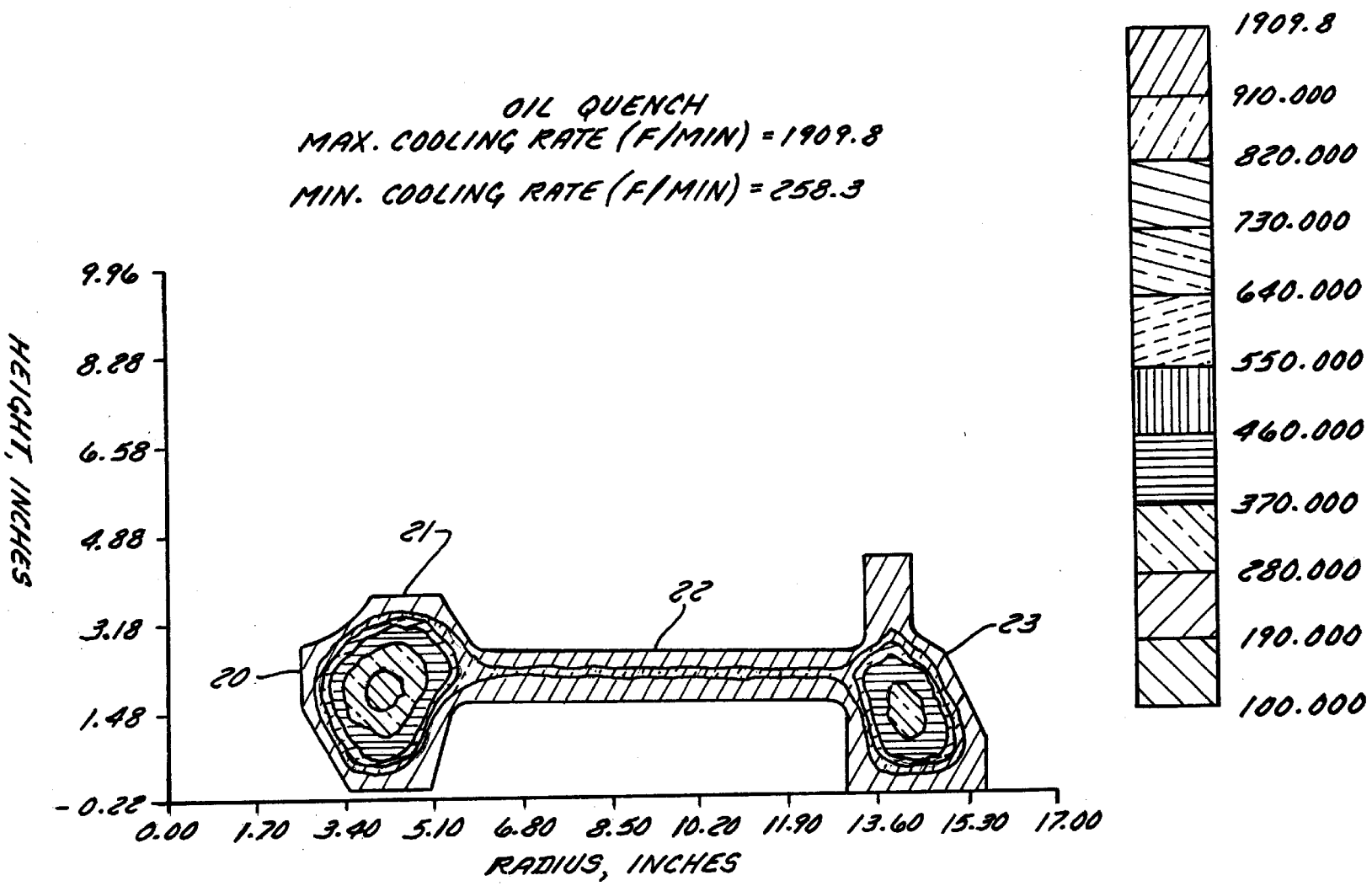
FIG. 4 is a graphic illustration of the cooling rate of the work piece illustrated in FIG. 2 utilizing a conventional oil quench.
Figure 5:
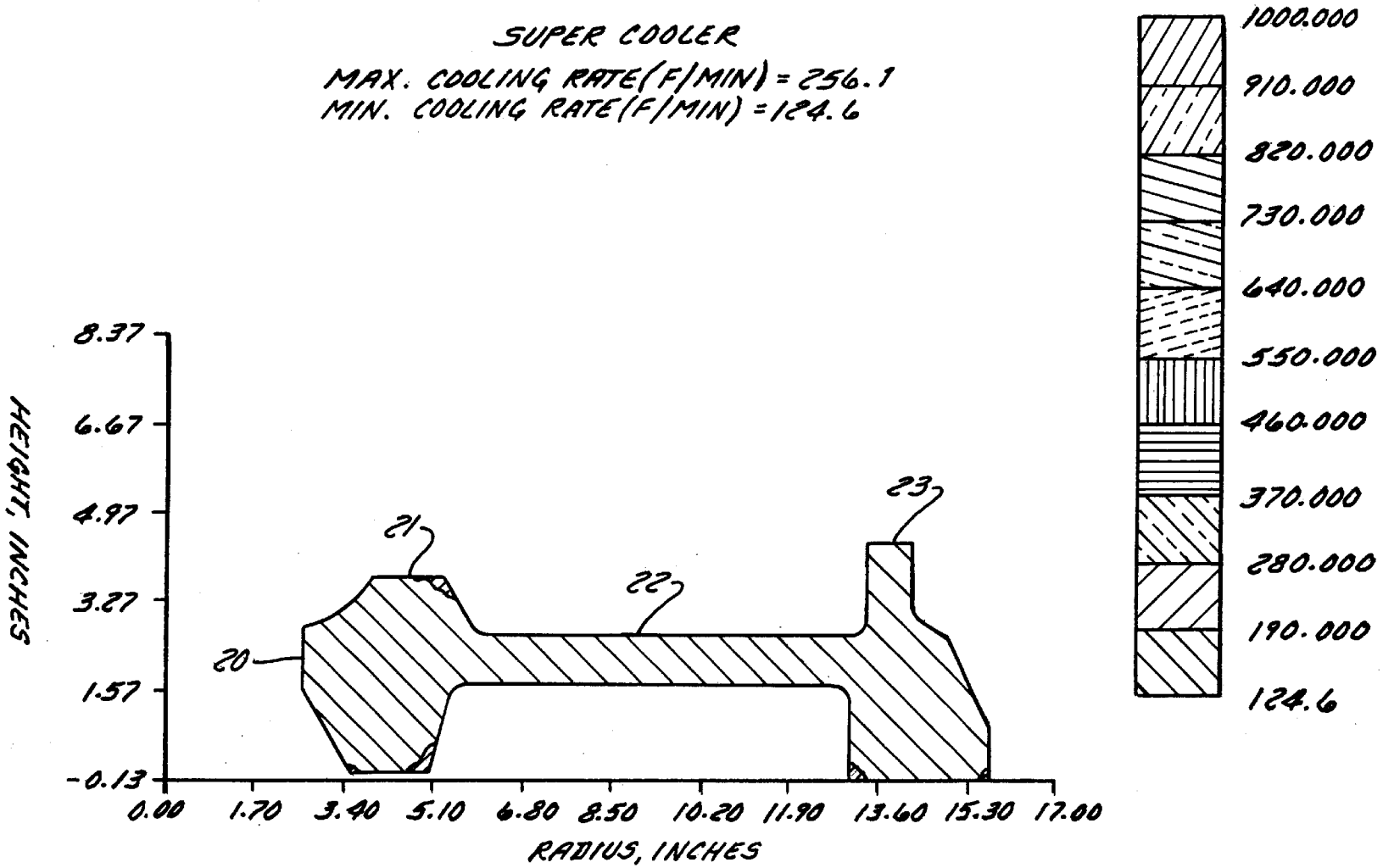
FIG. 5 is a graphic illustration of the cooling rate of the work piece illustrated in FIG. 2 using the apparatus and method of the present invention.

The effect on the cooling rate of the work piece utilizing the cooling method just describe in comparison to a conventional oil quenching method can be seen by comparing the cooling rates illustrated in FIGS. 4 and 5. FIGS. 4 and 5 illustrate the comparative cooling rates for part 20 shown in FIG. 2. (In FIGS. 4 and 5, the radial cross section for just the right hand side of the part is shown. Because the part is round, the cooling rate profile is the same at all point around the entire circumference of the part.) FIG. 4 illustrates the cooling rate of the work piece utilizing a conventional oil quench. As can be seen, the surface of the part cools very quickly, while the interior portion of the thick, larger portions of the part cool at a substantially slower rate. The net result is that the first portion 21 and third portion 23 of the part, which are of course the thicker and more massive portions of the part, are cooled at a significantly different rate than the second portion 22 of the part, which is of course the relatively thinner and less massive portion of the part.

In comparison, FIG. 5 illustrates the cooling rate of the work piece using the apparatus and method of the present invention. As can be seen, the entire work piece cools at a much more uniform rate.

Figure 6:
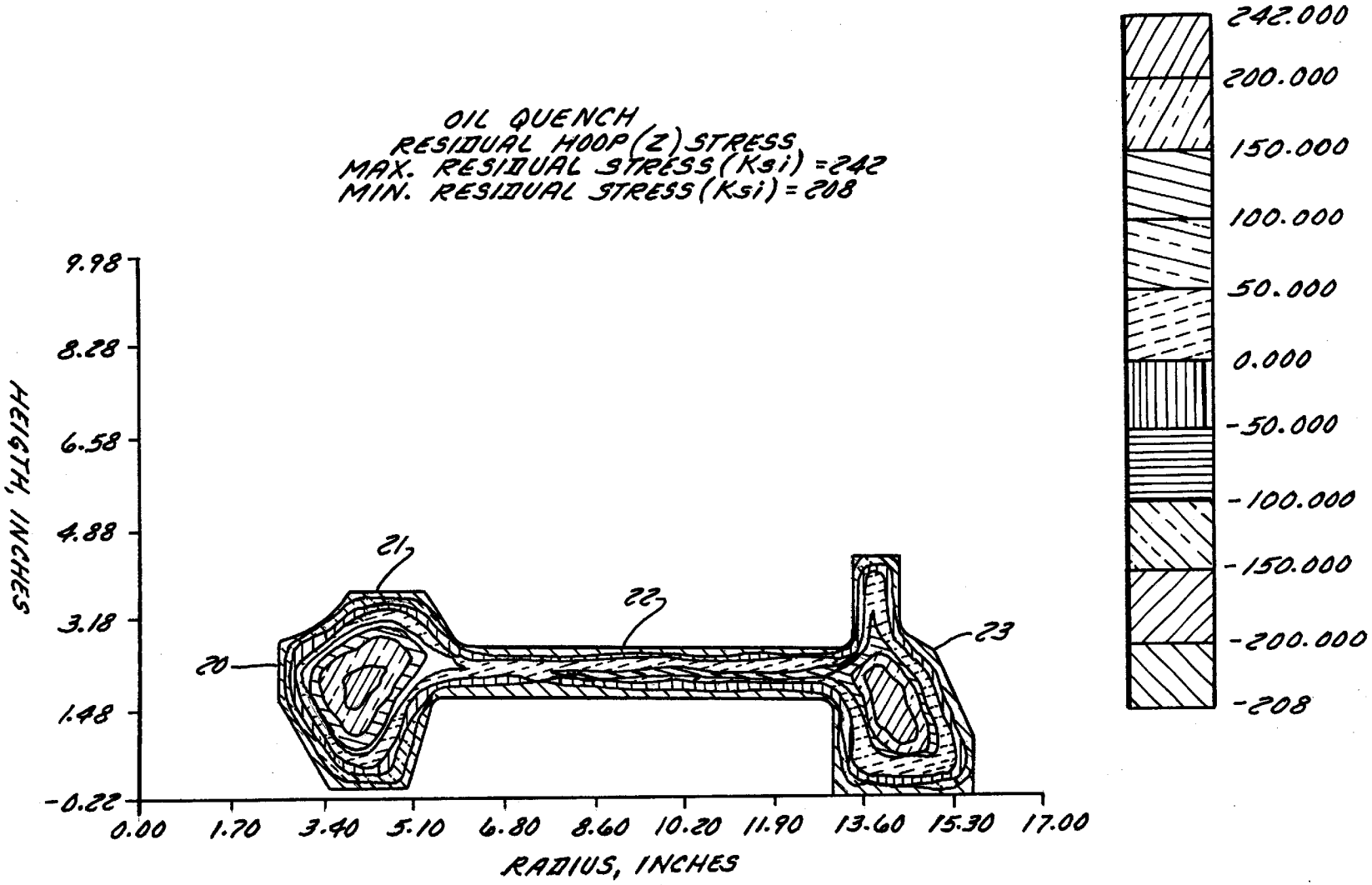
FIG. 6 is a graphic illustration of the residual stress produced in the work piece shown in FIG. 2 when the part is heat treated and quenched with a convention oil quench.
Figure 7:
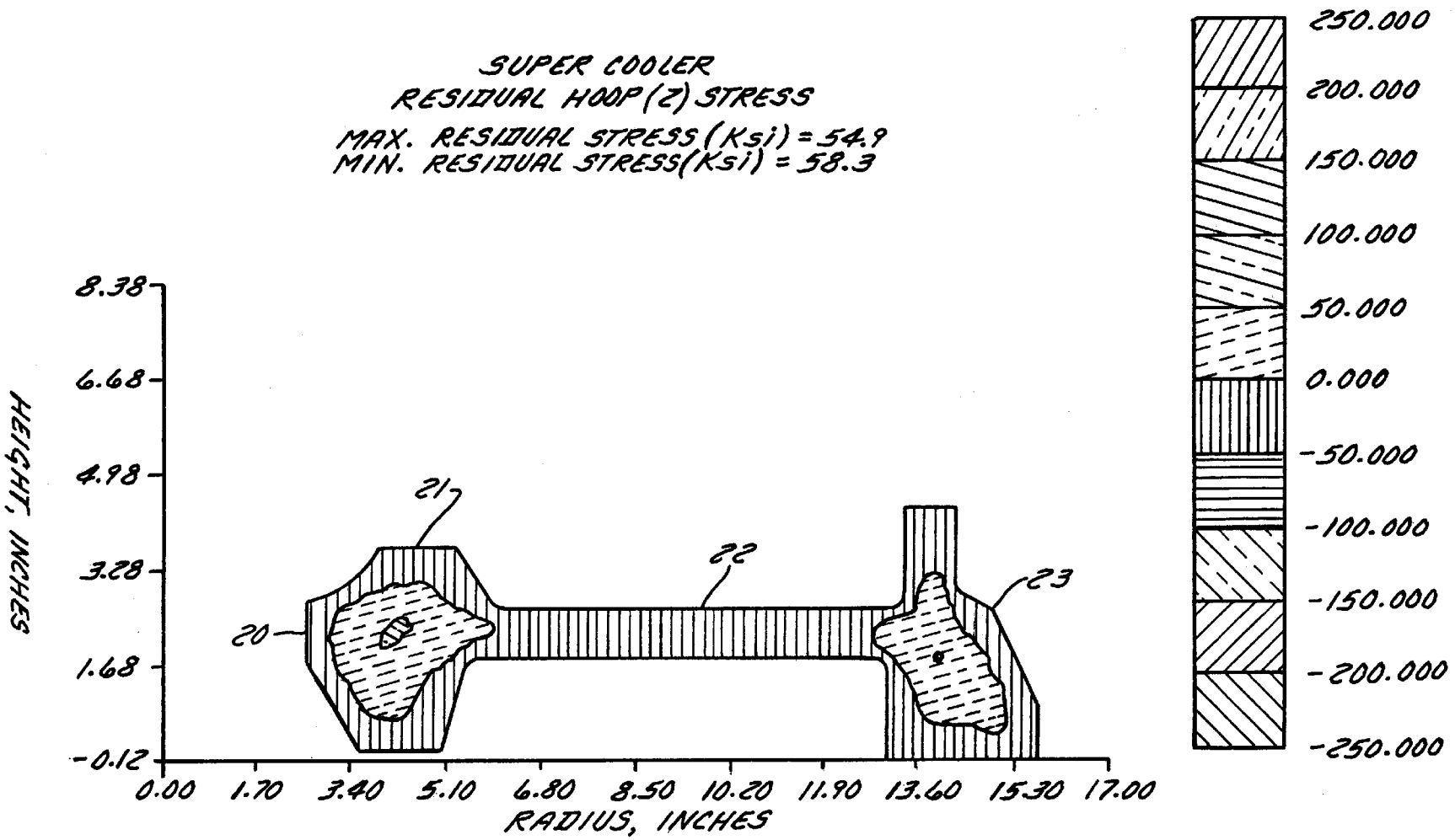
FIG. 7 is a graphic illustration of the residual stress of the work piece shown in FIG. 2 when heat-treated and cooled utilizing the apparatus and method of the present invention.

A comparison of FIGS. 6 and 7 shows the difference in the internal stresses that develop in the work piece when using the cooling method of the present invention in comparison to a conventional oil quenching method. FIGS. 6 and 7 also relate to part 20 shown in FIG. 2. FIG. 6 illustrates the residual stress produced in the work piece when the part is heat treated and quenched with a convention oil quench. Oil quench produces an extremely wide range of internal stresses, particularly in the larger portions of the part. FIG. 7 illustrates the residual stress of the work piece when it is heat-treated and cooled utilizing the apparatus and method of the present invention. As can be seen, the more uniform cooling of the part greatly reduces the ultimate stress within the part, and also reduces the range of stresses developed in one portion versus another portion of the part. The reduced stresses greatly reduce the extent of distortion of the part that can occur in subsequent machining steps. FIGS. 4 and 6 illustrate the wide range of cooling rates and internal stresses that naturally occur during a conventional oil quenching process, while FIGS. 5 and 7 illustrate the relatively uniform cooling rates and internal stresses achieved using the invention. As mentioned, the invention disclosed herein may be further adapted to produce controlled differential cooling rates upon different portions of the part. In other words, the number and positioning of the cooling tubes, their pressure values and the type of cooling medium use may be modified to essentially invert the natural cooling rates of the part illustrated in FIG. 4 so that the more massive portions of the part 21 and 23 actually cool more quickly than the thin portion 22 of the part, and thereby selectively produce a certain desired internal stress in the part in order to achieve a certain desired characteristic.

Finally, the present invention has been described and illustrated with reference to two particular preferred embodiments, which naturally includes many specific details about the particular geometry of the exemplary parts shown. Of course, specific details of the preferred embodiments as described herein are not to be interpreted as limiting the scope of the invention, but are provided merely as a basis for the claims and for teaching one skilled in the art to variously practice and construct the present invention in any appropriate manner. Changes may be made in the details of the construction of various components of the invention, without departing from the spirit of the invention especially as defined in the following claims.

I claim:

1. An apparatus for cooling a heat-treated metallic work piece, said work piece being of a circular shape and thereby having a radial cross-section that is uniform about its entire circumference, said radial cross-section also being of a complex geometry including a first portion that is substantially thicker and more massive than a second portion that is relatively thinner and less massive, said apparatus comprising:

a. a fixture for supporting the work piece;

b. a source compressed cooling gas for quenching the work piece;

c. a set of tubes for delivering and directing the compressed cooling gas onto said work piece for cooling, said set of tubes including a first tube located on one side of the work piece and a second tube located on the other side of the work piece, each cooling gas delivery tube being circular in shape and located in close proximity to said first portion of the work piece that is substantially thicker and more massive, and each tube further comprising a multiplicity of bores aimed at the work piece so that said compressed cooling gas flows onto said first portion that is substantially thicker and more massive and away from said second portion that is relatively thinner and less massive.

2. The apparatus of claim 1, wherein the fixture comprises a stand for supporting the work piece in a horizontal position and further includes a means for centering the work piece so the circular work piece and the circular cooling gas delivery tubes are concentrically oriented relative to each other.

3. The apparatus of claim 2, wherein the set of compressed cooling gas delivery tubes includes at least one moveable tube.

4. The apparatus of claim 3, wherein the moveable tube is moveable in a vertical direction toward and away from the work piece.

5. The apparatus of claim 2, further comprising a first plurality of cooling gas delivery tubes located below the work piece, and a second plurality of cooling gas delivery tubes located above the work piece.

6. The apparatus of claim 5, where in the first plurality of cooling gas delivery tubes are in a fixed position relative to the fixture, and the second plurality of cooling gas delivery tubes are selectively moveable in a vertical direction toward and away from the work piece.

7. The apparatus of claim 5, further comprising a shield extending from one of the cooling gas delivery tubes toward the work piece, said shield being positioned relative to the first portion of the work piece so as to direct the flow of compressed cooling gas away from the second thinner and less massive portion of the work piece.

8. The apparatus of claim 7, where in the shield is attached to one of the cooling gas delivery tubes that is located above the work piece.

9. The apparatus of claim 7, further comprising a second shield extending from a second cooling gas delivery tube toward the work piece, said second shield being attached to one of the cooling gas delivery tubes that is located below the work piece and is also positioned relative to the first and portion of the work piece so as to direct a greater flow of compressed cooling gas towards the first thicker and more massive portion of the work piece than is directed towards the second thinner and less massive portion of the work piece.

10. The apparatus of claim 1, further comprising a shield extending from at least one of the cooling gas delivery tubes toward the work piece, said shield being positioned relative to the first and second portions of the work piece so as to block the flow of compressed cooling gas away from the second thinner and less massive portion of the work piece.

11. The apparatus of claim 1, further comprising a plurality of cooling gas delivery tubes on one side of the work piece, and a second plurality of cooling gas delivery tubes on the other side of the work piece.

12. The apparatus of claim 1, wherein the radial cross-section of the work piece further includes a third portion that is substantially thicker and more massive than the second portion, and the set of cooling gas delivery tubes further comprising a third circular tube located in close proximity to said third portion of the work piece.

13. The apparatus of claim 1, wherein the bores in the tubes are space about 1/16 to 2 inches apart from each other around the circumference of the circular tube.

14. The apparatus of claim 1, wherein all tubes in the set of tubes are connected to the same source of compressed cooling gas so that all tubes are supplied with a compressed cooling gas quench of substantially the same pressure and temperature.

15. The apparatus of claim 1, further comprising an air manifold that includes a first pressure regulator connected to the first delivery tube and a second pressure regulator connected to the second delivery tube, said air manifold thereby supplying compressed cooling gas having a first pressure value to the first tube, and supplying compressed cooling gas having a second pressure value to the second tube.

16. The apparatus of claim 15, wherein the pressure value in at least one of the compressed cooling gas delivery tubes is adjustable during the period of cooling the work piece.

17. A method of cooling a heat-treated metallic work piece, said work piece being of a circular shape and thereby having a radial cross-section that is uniform about its entire circumference, said radial cross-section also being of a complex geometry including a first portion that is substantially thicker and more massive than a second portion that is relatively thinner and less massive, said method comprising:

a. heating the work piece in a furnace to a predetermined temperature and for a predetermined time;

b. removing the work piece from the furnace and placing it onto a fixture for cooling;

c. providing a source compressed cooling for quenching the work piece;

d. placing a set of circular tubes in close proximity to the work piece, said step including locating at least one tube on one side of the work piece and further locating at least a second tube on the other side of the work piece, each tube being placed in close proximity to said first portion of the work piece that is substantially thicker and more massive, and each tube further comprising a multiplicity of bores aimed at said first portion of the work piece e. initiating a flow of compressed cooling gas from the source through the tubes and through the bores so that the gas is directed onto the first portion of the work piece that is substantially thicker and more massive and away from the second portion that is relatively thinner and less massive.

18. The method of claim 17, wherein the step of placing the work piece onto a fixture includes orienting the work piece in a horizontal position and further includes centering the work piece so the circular work piece and the circular cooling gas delivery tubes are concentrically oriented relative to each other.

19. The method of claim 18, where in the step of placing a set of cooling gas delivery tubes in close proximity to the work piece includes placing at least one tube in a fixed position on a lower portion of the fixture so that when the work piece is placed onto the fixture the tube is located below the work piece, and then placing at least one moveable tube above the work piece.

20. The method of claim 17, further comprising placing a first shield onto the fixture so that it extends from one of the delivery tubes toward the work piece, and positioning the first shield relative to the first and second portions of the work piece so that the shield blocks the flow of compressed cooling gas away from the second thinner and less massive portion of the work piece.

21. The method of claim 20, further comprising placing a second shield onto the fixture so that it extends from the second cooling gas delivery tube towards the other side of the work piece, and positioning the relative to the first and second portions of the work piece so that the shield blocks the flow of compressed cooling gas away from the second thinner and less massive portion of the work piece.

22. The method of claim 17, wherein the step of placing a set of cooling gas delivery tubes in close proximity to the work piece includes placing a first plurality of tubes on one side of the work piece, and further placing a second plurality of tubes on the other side of the work piece.

23. The method of claim 22, wherein the radial cross-section of the work piece further includes a third portion that is substantially thicker and more massive than the second portion, and the step of placing a set of cooling gas delivery tubes in close proximity to the work piece includes locating a third circular tube in close proximity to said third portion of the work piece.

24. The method of claim 17, wherein the step of initiating a flow of compressed cooling gas through the tubes includes supplying all tubes in the set of tubes with a compressed cooling gas quench of substantially the same pressure and temperature.

25. The method of claim 17, wherein the step of initiating a flow of compressed cooling gas through the tubes includes supplying compressed cooling gas having a first pressure value to the first tube, and supplying compressed cooling gas having a second pressure value to the second tube.

26. The method of claim 25, further comprising the step of changing the pressure value in at least one tube during the cooling step.

* * * * *